US006396647B1

(12) United States Patent
Chen

(10) Patent No.: US 6,396,647 B1
(45) Date of Patent: May 28, 2002

(54) OPTICAL SYSTEM WITH EXTENDED BORESIGHT SOURCE

(75) Inventor: Chungte W. Chen, Irvine, CA (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/542,354

(22) Filed: Apr. 3, 2000

(51) Int. Cl.[7] ..... G02B 9/00; F41G 1/34

(52) U.S. Cl. ..... 359/738; 359/619; 359/622; 359/399; 359/799; 362/111; 362/268; 356/241.1

(58) Field of Search ..... 359/619, 626, 359/638, 399, 622, 799, 738; 362/111, 268; 356/241.1–241.6

(56) References Cited

U.S. PATENT DOCUMENTS 4,339,377 A 7/1982 March ..... 359/707
4,918,583 A * 4/1990 Kudo et al. ..... 362/268
5,054,917 A 10/1991 Pepin et al. ..... 356/139.08
5,838,014 A 11/1998 Buckwald et al. ..... 250/504 R
6,072,572 A * 6/2000 Hatfield et al. ..... 250/342
6,100,961 A * 8/2000 Shiraishi et al. ..... 355/53
6,307,682 B1 * 10/2001 Hoffman et al. ..... 359/619
6,341,876 B1 * 1/2002 Moss et al. ..... 362/243

* cited by examiner

*Primary Examiner*—Evelyn A Lester
(74) *Attorney, Agent, or Firm*—Colin M. Raufer; Leonard A. Alkov; Glenn H. Lenzen, Jr.

(57) ABSTRACT

An optical system has an extended boresight source including a boresight light source that produces a light beam, a condenser lens that receives the light beam from the boresight light source, a spatial light integrator that receives the light beam from the condenser and mixes the light beam to reduce its spatial inhomogeneities, a constriction through which the light beam from the spatial light integrator is directed, and a collimator that receives the light beam which passes through the constriction and outputs a boresight light beam. The boresight light beam is typically provided to a sensor imager that uses the boresight light beam to establish its centroid.

19 Claims, 3 Drawing Sheets

OPTICAL SYSTEM WITH EXTENDED BORESIGHT SOURCE

This invention relates to an optical system and, more particularly, to an optical system with a boresight source that is used to establish the centroid of a sensor imager.

BACKGROUND OF THE INVENTION

In one type of optical system, a telescope directs the light from a scene to a photosensitive device such as a focal plane array (FPA). The light may be of any suitable wavelength and is typically in the visible and/or infrared ranges. Some optical systems utilize two different wavelength ranges, such as the visible and the infrared. The FPA converts the incident light into electrical signals, which are then processed electronically in a tracker for viewing or automated image analysis.

In order to determine the location of the image relative to the plane of the FPA, a boresight source is provided. The boresight source creates a uniform boresight light beam at the FPA so that the tracker portion of the optical system may precisely locate the centroid of the FPA. The image of the scene is then related to this precisely located centroid.

The boresight accuracy and thence the accuracy of the optical system are determined by several factors, including the uniformity of the boresight light beam and the temperature difference between the boresight source and the background. The boresight source must therefore generate the boresight light beam with high spatial uniformity. The boresight light source produces a light beam that is somewhat nonuniform. In conventional practice, the boresight light beam is directed through a pinhole to improve its spatial uniformity. The size of the pinhole is often limited to a few thousandths of an inch in diameter to achieve the desired beam spatial uniformity. Consequently, the beam passing through the pinhole does not have sufficient brightness and signal-to-noise ratio to provide the required boresight accuracy.

Although a coherent light source such as a laser diode may be used to increase the brightness, the beam uniformity is greatly degraded due to the speckles associated with a typical coherent light source. One way to achieve the uniform beam is to employ a pinhole with a diameter around one-half of the size of the Airy disk, which is typically about 10 to 20 micrometers for the visible and near-infrared wavelength. Most of the energy of the light source does not pass through this small pinhole and is lost. Additionally, it is quite difficult to fabricate a highly precise pinhole of this small a size suitable for use in the boresight source. The result of using an imprecise pinhole is that the spot of radiation on the FPA is not uniform, and the accuracy of the tracker is degraded. The small pinhole also leads to a low efficiency and a low signal-to-noise ratio.

There is a need for an improved approach to the boresight source, which allows the optical system to maintain high accuracy even for operation in the visible and short-wavelength infrared ranges. The present invention fulfills this need, and further provides related advantages.

SUMMARY OF THE INVENTION

The present invention provides an optical system which includes an extended boresight source. The boresight source produces a beam which is highly spatially uniform and collimated, even for operating wavelengths in the visible and short-wavelength infrared ranges. The boresight source of the invention does not require any change in the structure and operation of the remainder of the optical system, which may be optimized for its performance.

An optical system having an extended boresight source comprises a boresight light source that produces a light beam, a condenser lens that receives the light beam from the boresight light source, a spatial light integrator that receives the light beam from the condenser, a constriction through which the light beam from the spatial light integrator is directed, and a collimator that receives the light beam which passes through the constriction and outputs a boresight light beam. The optical system usually further includes a sensor imager that receives the boresight light beam from the collimator and uses the boresight light beam for locating and alignment purposes.

The boresight light source preferably emits light in the wavelength range of from about 0.4 to about 12 micrometers, and is preferably a light bulb. In some applications, the light source may be a laser diode, whose driving voltage or current may be modulated to achieve temporal incoherence. The spatial light integrator may be a light pipe, such as a refractive rectangular light pipe or a hollow reflective rectangular light pipe. The spatial light integrator may instead be a combination of a lens array that receives the light beam from the condenser lens and a focusing lens that receives the light beam from the lens array. The constriction may be a field stop or a pinhole, for example.

The approach of the invention produces a highly spatially uniform boresight light beam even though the boresight light source may be somewhat nonuniform. The centroid of the light sensor may therefore be located very accurately, with a corresponding high accuracy of the tracker of the optical system. The present approach does not depend upon diffraction effects to achieve a uniform boresight light beam, and is accordingly readily implemented in practice and is optically efficient. Other features and advantages of the present invention will be apparent from the following more detailed description of the preferred embodiment, taken in conjunction with the accompanying drawings, which illustrate, by way of example, the principles of the invention. The scope of the invention is not, however, limited to this preferred embodiment.

DETAILED DESCRIPTION OF THE INVENTION

Figure 1:
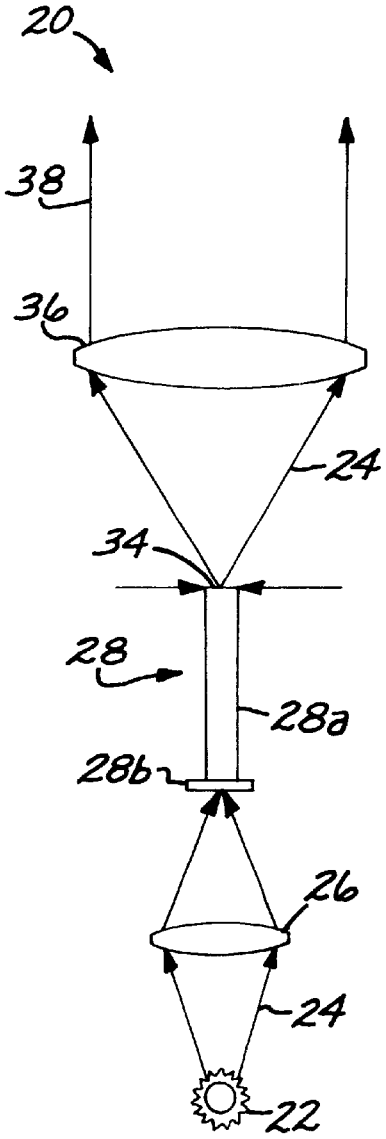
FIG. 1 is a schematic drawing of an optical system having a first embodiment of an extended boresight source.
Figure 2:
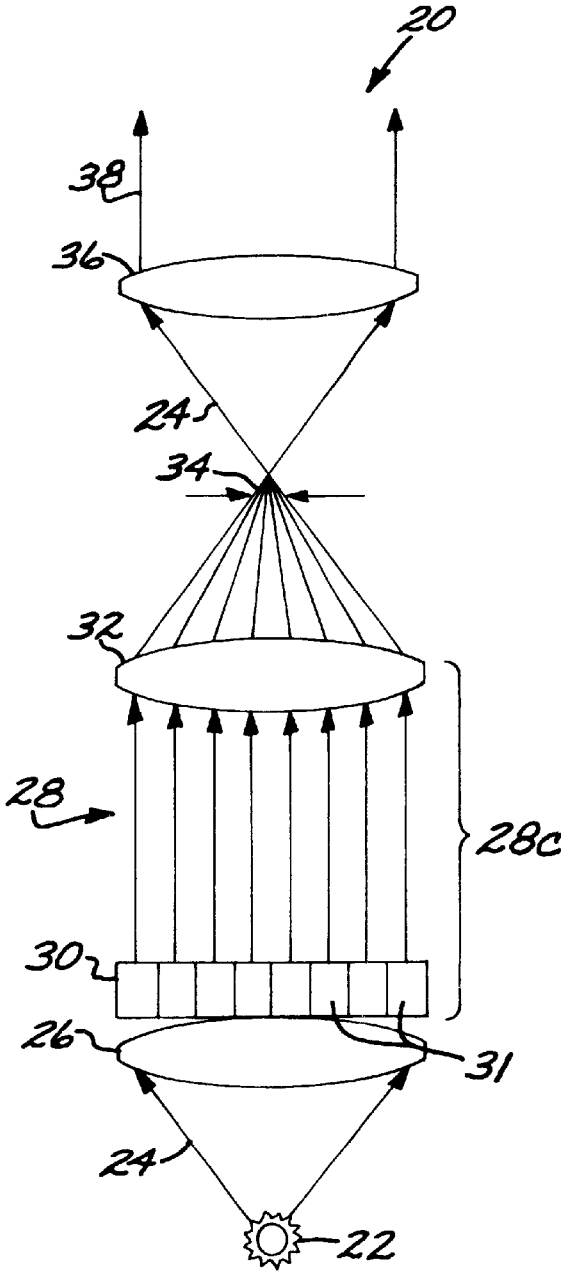
FIG. 2 is a schematic drawing of an optical system having a second embodiment of the extended boresight source.

FIGS. 1 and 2 depict two embodiments of an optical system 20 according to the invention. In each case, the optical system 20 includes a boresight light source 22 that produces a light beam 24. The boresight light source 22 may be of any operable type, and is preferably a bulb. In some applications, the light source may be a monochromatic light source such as a laser diode, preferably with a modulator to modulate the driving voltage or current of the laser diode to achieve temporal incoherence and further improve the light beam. The boresight light source 22 emits light of any operable wavelength, preferably in the wavelength range of from about 0.4 to about 12 micrometers, more preferably in the infrared wavelength range, and most preferably in the short-wavelength infrared range of from about 3 to about 5 micrometers or the long-wavelength infrared range of from about 8 to about 12 micrometers. As used herein, "light" can include energy in the ultraviolet, visible, or infrared ranges, or any combination of these ranges.

A condenser lens 26 receives the light beam 24 from the boresight light source 22 and focuses the light beam 24 onto a spatial light integrator 28. The spatial light integrator 28 mixes the light rays in the light beam 24, so as to even out any irregularities that arise, for example, from the image of the filament in the boresight light source 22. Any operable spatial light integrator 28 may be used. In the embodiment of FIG. 1, the spatial light integrator 28 comprises a light pipe 28*a*. The light pipe 28*a* may be, for example, a ZnSe (zinc selenide) light pipe, and the light pipe may have the form of a refractive rectangular light pipe or a hollow reflective rectangular light pipe. The uniformity of the light beam may be further improved by the use of a scattering optical element such as a ground glass 28*b* in optical series with the light pipe 28*a*.

In the embodiment of FIG. 2, the spatial light integrator 28 is an integrating lens system 28*c*. The integrating lens system 28*c* includes a lens array 30 having a plurality of individual lenses 31 in a side-by-side arrangement across the light beam 24, located at the aperture of the condenser lens 26. The lens array 30 receives the light beam 24 from the boresight light source 22. A focusing lens 32 that receives the light beam 24 from the lens array 30 further integrates the light beam 24 and focuses the light beam 24 to a converged spot.

In either embodiment, the light beam 24 leaves the spatial light integrator 28 and passes through a constriction 34. The light beam 24 is focused to a spot at this point, either because of the geometry of the light pipe 28*a* of FIG. 1 or the converging focusing lens 32 of FIG. 2. The constriction 34 is in the form of a pinhole or a field stop of any operable size. The constriction 34 of the present invention is different from the pinhole of the prior approach, which must be sufficiently small to diffract the beam. Here, the constriction is sufficiently large in size that it does not substantially diffract the light beam passing therethrough. The constriction 34 typically has a size of about 200 micrometers diameter. Such a larger-size constriction is much easier to fabricate than a smaller diffracting pinhole.

The light beam 24 passing through the constriction 34 is received by a collimator lens 36, which outputs a parallel boresight light beam 38. The boresight light beam 38 is spatially uniform, not as a result of diffraction effects but as a result of the spatial integration effects of the spatial light integrator 28. There is no need to form a precise diffraction element, such as a tiny pinhole, as in the prior approaches. The constriction 34 is much larger than a diffraction element, and may be readily fabricated.

The required boresight beam size is obtained by selection of the aperture of the light integrator 28 and the effective focal length of the collimator lens 36. The smaller the aperture of the light integrator 28, the wider the spread of the light beam coming out of the light integrator 28, and the shorter the effective focal length of the collimator lens 36.

Figure 3:
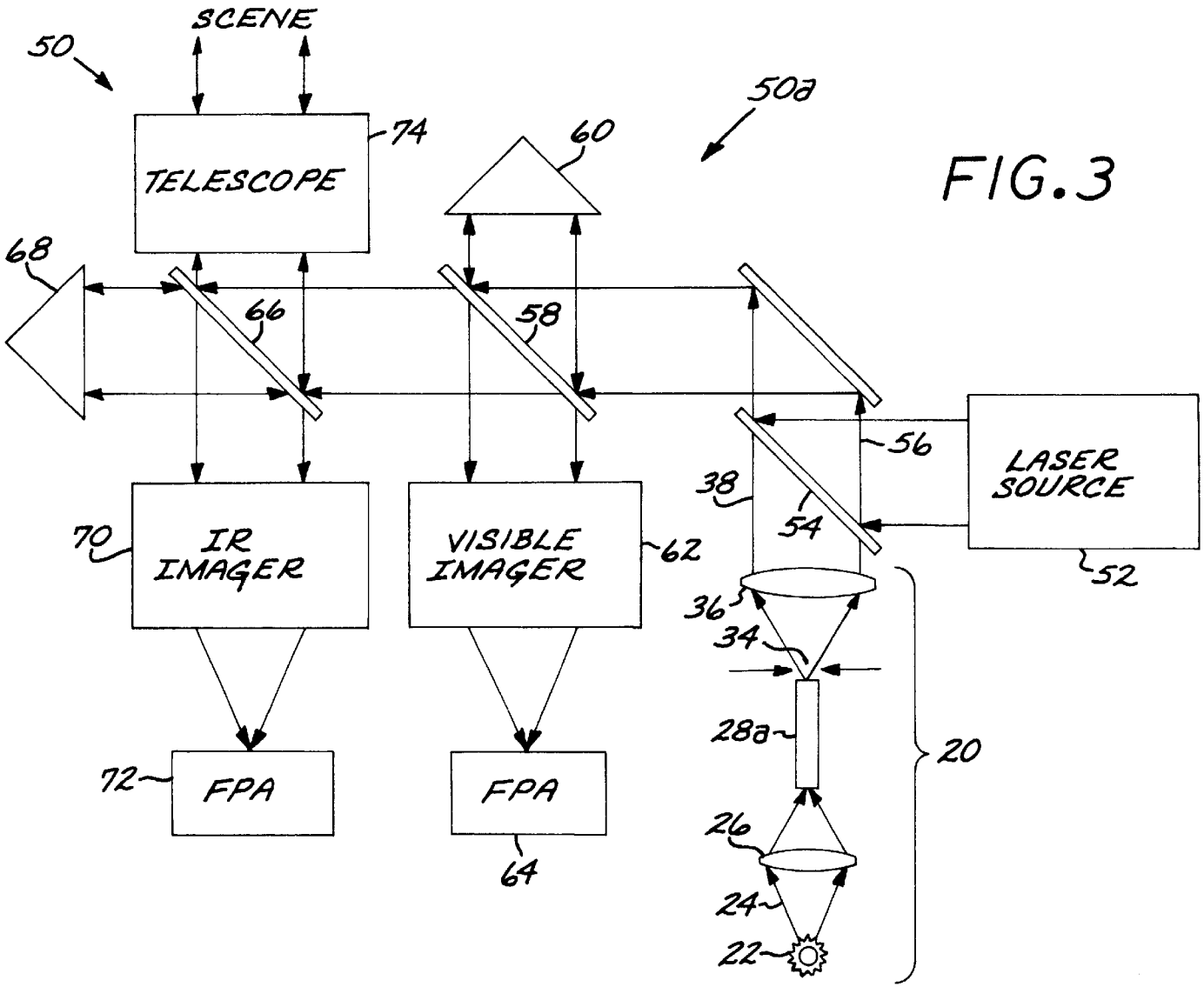
FIG. 3 is a schematic drawing of an optical system including the sensor imager and an extended boresight source for internal boresight calibration.
Figure 4:
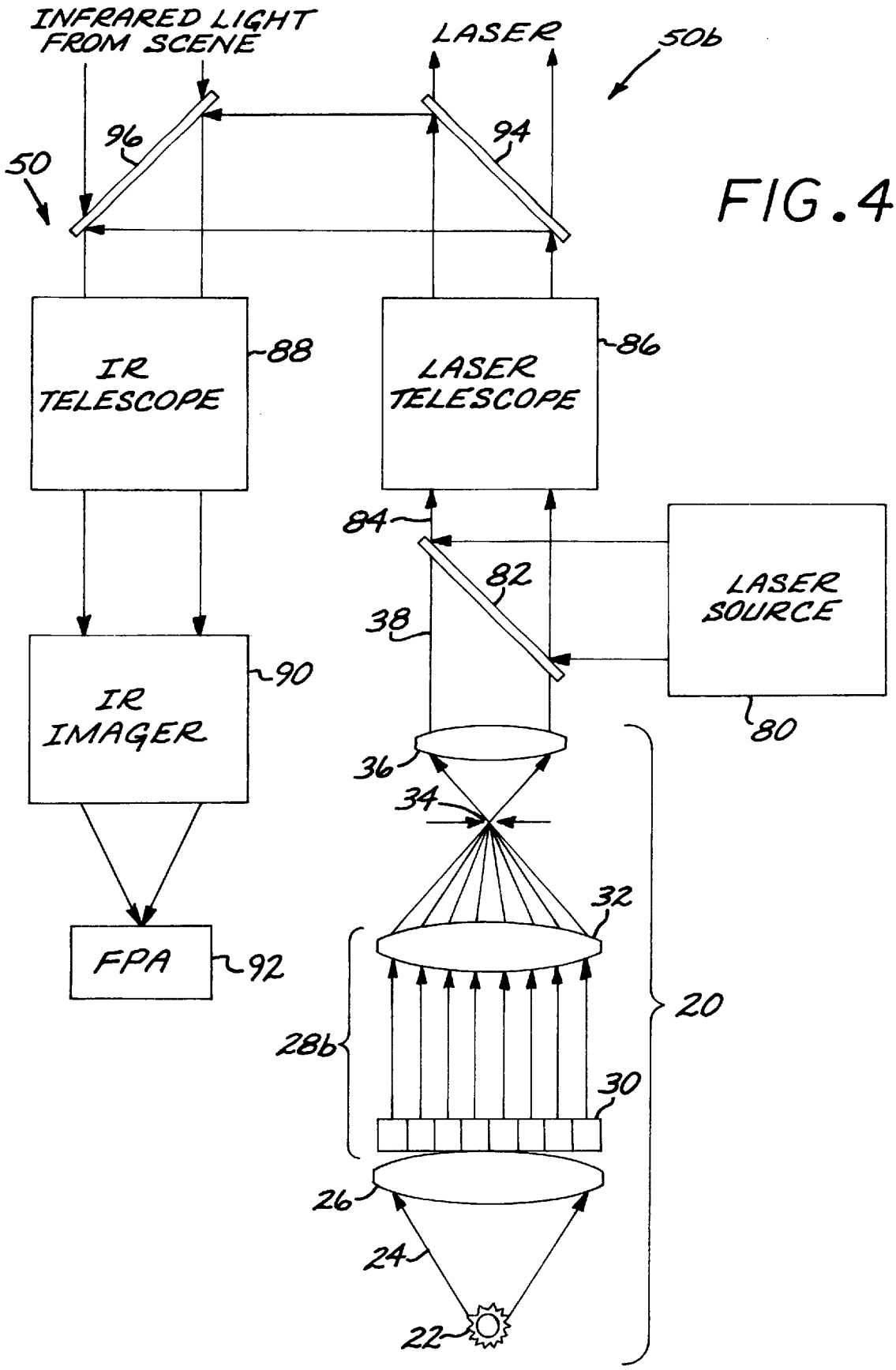
FIG. 4 is a schematic drawing of an optical system including the sensor imager and an extended boresight source for external boresight calibration.

Two preferred applications of the optical system 20 are illustrated in FIGS. 3–4, although the use of the optical system 20 is not limited to these preferred applications. In each case, an optical system 50 utilizes the optical system 20 to provide the extended boresight source required for a focal plane array sensor, in an optical system that processes both visible and infrared light. An internal boresight calibration optical system 50*a*, shown in FIG. 3, receives the infrared boresight light beam 38 from the optical system 20, and mixes it with laser light from a laser source 52 at a beam combiner 54 in the form of a dielectric-coated beam splitter. A resulting boresight light beam 56 is relayed to a dichroic visible beam splitter 58, wherein the visible portion of the boresight light beam 56 and a much smaller fraction of the laser light are reflected to a visible corner cube 60 and thence to a visible imager 62, which is preferably a lens system, and a visible-light focal plane array (FPA) 64. The majority of the laser energy transmits through the beam splitter 58 and is reflected from an infrared beam splitter 66 and further projected by a telescope 74 for the purpose of either designation or ranging. A lesser portion of the infrared portion of the boresight light beam 56 is transmitted through the visible beam splitter 58, through the infrared beam splitter 66, to an infrared corner cube 68, and thence via reflection from the back side of the infrared beam splitter 66 to an infrared imager 70 and an infrared focal plane array 72. The input light beam from the scene is directed through the conventional telescope 74 and thence to the two focal plane arrays 64 and 72 by reflection by the various elements.

An external boresight calibration optical system 50*b*, shown in FIG. 4, receives the infrared boresight light beam 38 from the optical system 20, and mixes it with a small fraction of the laser light from a laser source 80 at a beam combiner 82 in the form of a multi-layered dielectric coating, forming a mixedlight beam 84. The mixed-light beam 84 is projected to the target by a visiblelight laser telescope 86. A portion of the beam is reflected by fold mirrors 94 and 96 to an infrared telescope 88, and thence to an infrared imager 90 and an infrared sensor 92, preferably. in the form of a focal plane array. The fold mirrors 94 and 96 are in the illustrated position for boresight calibration. During service in a mission, the fold mirrors 94 and 96 are flipped out of the beam path such that the infrared radiation from the scene is imaged by the infrared sensor 92 and the laser beam from the laser telescope 86 illuminates the target.

In each of these cases of FIGS. 3–4, the optical system 20 provides a precisely located boresight light beam used in the locating of the centroid of the focal plane array.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An optical system having an extended boresight source, comprising:

a boresight light source that produces a light beam;

a condenser lens that receives the light beam from the boresight light source;

a spatial light integrator that receives the light beam from the condenser lens;

a constriction through which the light beam from the spatial light integrator is directed; and a collimator that receives the light beam which passes through the constriction and outputs a boresight light beam.

2. The optical system of claim 1, wherein the boresight light source produces light within a wavelength range of from about 0.4 to about 12 micrometers.

3. The optical system of claim 1, wherein the boresight light source comprises a light bulb.

4. The optical system of claim 1, wherein the boresight light source comprises a laser.

5. The optical system of claim 1, wherein the boresight light source comprises a modulator which electronically modulates the driving current of the light source.

6. The optical system of claim 1, wherein the boresight light source comprises a modulator which electronically modulates the driving voltage of the light source.

7. The optical system of claim 1, wherein the spatial light integrator comprises a light pipe.

8. The optical system of claim 1, wherein the spatial light integrator comprises a scattering ground glass.

9. The optical system of claim 1, wherein the spatial light integrator comprises a refractive rectangular light pipe.

10. The optical system of claim 1, wherein the spatial light integrator comprises a hollow reflective rectangular light pipe.

11. The optical system of claim 1, wherein the spatial light integrator comprises a combination of a lens array that receives the light beam from the condenser lens and a focusing lens that receives the light beam from the lens array.

12. The optical system of claim 1, wherein the constriction comprises a field stop.

13. The optical system of claim 1, wherein the constriction comprises a pinhole.

14. The optical system of claim 1, wherein the constriction is sufficiently large in size that it does not substantially diffract the light beam passing therethrough.

15. The optical system of claim 1, further including a sensor imager that receives the boresight light beam from the collimator.

16. An optical system having an extended boresight source, comprising:

a boresight light source that produces a light beam;

a condenser lens that receives the light beam from the boresight light source;

a spatial light integrator that receives the light beam from the condenser, the spatial light integrator being selected from the group consisting of a light pipe, and a combination of a lens array that receives the light beam from the condenser lens and a focusing lens that receives the light beam from the lens array;

a constriction through which the light beam from the spatial light integrator is directed;

a collimator that receives the light beam which passes through the constriction and outputs a boresight light beam; and a sensor imager that receives the boresight light beam from the collimator.

17. The optical system of claim 15, wherein the sensor imager comprises a focal plane array.

18. An imaging optical system having an extended boresight source, comprising:

a boresight light source that produces a light beam;

a condenser lens that receives the light beam from the boresight light source;

a spatial light integrator that receives the light beam from the condenser;

a constriction through which the light beam from the spatial light integrator is directed;

a collimator that receives the light beam which passes through the constriction and outputs a boresight light beam; and a sensor imager that receives the boresight light beam from the collimator, the sensor imager comprising at least one focal plane array.

19. The optical system of claim 18, wherein the at least one focal plane array comprises two focal plane arrays, one sensitive to infrared light and the other sensitive to visible light.

* * * * *